US007156710B2

(12) United States Patent
Yokoya et al.

(10) Patent No.: US 7,156,710 B2
(45) Date of Patent: Jan. 2, 2007

(54) EXHAUST SYSTEM FOR SMALL-SIZED BOAT

(75) Inventors: Noboru Yokoya, Saitama (JP); Takeshi Kimishima, Saitama (JP); Yasunori Okazaki, Saitama (JP); Takeshi Koyabu, Saitama (JP); Masatsugu Matsumoto, Saitama (JP); Yoshiaki Noda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 60 days.

(21) Appl. No.: 10/791,361

(22) Filed: Mar. 2, 2004

(65) Prior Publication Data

US 2005/0020152 A1 Jan. 27, 2005

(30) Foreign Application Priority Data

Mar. 12, 2003 (JP) ..... 2003-065970

(51) Int. Cl.
*B63H 21/12* (2006.01)

(52) U.S. Cl. ..... 440/89 J

(58) Field of Classification Search ..... 440/89 R, 440/89 F, 89 J, 89 H; 181/259
See application file for complete search history.

(56) References Cited

U.S. PATENT DOCUMENTS 4,019,456 A * 4/1977 Harbert ..... 440/88 R
4,124,092 A * 11/1978 Kajiya et al. ..... 181/265
4,416,350 A * 11/1983 Hayashi ..... 181/272
5,464,357 A * 11/1995 Craig et al. ..... 440/89 R
6,764,361 B1 * 7/2004 Matsuda ..... 440/89 B

FOREIGN PATENT DOCUMENTS

JP 08119196 A 5/1996
JP 10212936 A 8/1998

* cited by examiner

*Primary Examiner*—Ed Swinehart
(74) *Attorney, Agent, or Firm*—Carrier, Blackman & Associates, P.C.; William D. Blackman; Joseph P. Carrier

(57) ABSTRACT

An exhaust system for a small-sized boat which can efficiently reduce exhaust noises in a low frequency band includes a water muffler provided at one location along exhaust pipes extending from an engine disposed in a boat body. The inside of the water muffler is divided into a single expansion chamber and a resonator chamber, and a front exhaust pipe coupled to the engine and a rear exhaust pipe opened to the outside of the boat are connected to the expansion chamber. Between the front exhaust pipe opened to the inside of the expansion chamber and the rear exhaust pipe, a water-controlling plate is provided in an upper side of the expansion chamber.

20 Claims, 3 Drawing Sheets

EXHAUST SYSTEM FOR SMALL-SIZED BOAT

CROSS-REFERENCE TO RELATED APPLICATION

The present application claims priority under 35 USC 119, based on Japanese patent application No. 2003-065970, filed Mar. 12, 2003.

BACKGROUND OF THE INVENTION

1. Field of the Invention

The present invention relates to an exhaust system for a small-sized boat. More particularly, the present invention relates to an exhaust system for a small-sized boat that reduces low-frequency exhaust sounds.

2. Description of the Background Art

A conventional exhaust system for a small-sized boat includes a water muffler at one point along exhaust pipes extending from an engine disposed in the boat body, and the water muffler includes a plurality of expansion chambers (see Japanese Patent Laid-Open No. Heisei 10-212936 (Abstract, Paragraph 0027, FIG. 1 and FIG. 3), for example).

In addition, there is another known exhaust system that includes two water mufflers (see Japanese Patent Laid-Open No. Heisei 8-119196 (Abstract, Paragraph 0012, FIG. 2), for example).

The above-described conventional exhaust systems are considered to be suitable for reducing exhaust noises in a relatively high frequency band, since the water mufflers thereof include a plurality of expansion chambers.

However, exhaust noises in a region of about 3000 to 7000 rpm of engine revolutions (for example, in a case of a four-cycle four-cylinder engine, a region of about 100 to 200 Hz) are in fact disturbing noises in a small-sized boat. Moreover, since a small-sized boat discharges cooling water into exhaust gas (see the foregoing discussed Japanese Patent Documents), exhaust gas temperature becomes 100° C. or below, and it has become clear that high frequency noises are not generated under such a condition.

In other words, there have been problems, with respect to the conventional exhaust systems for small-sized boats, that they include a plurality of expansion chambers which are actually not necessary, and also that they cannot effectively reduce exhaust noises in a low frequency band, which are most disturbing noises in small-sized boats.

Furthermore, when there are two mufflers, one of the mufflers can reduce low frequency waves; however, there have been problems that the capacity thereof is doubled, that the layout in a narrow space of the boat is difficult, and that cost thereof is also doubled.

SUMMARY OF THE INVENTION

An object of the present invention is to solve the above-described problems and to provide an exhaust system for a small-sized boat that can effectively reduce exhaust noises in a low frequency band.

In order to solve the aforementioned problems, according to one aspect of the invention there is provided an exhaust system of a small-sized boat including a water muffler at one point along exhaust pipes extending from an engine disposed in a boat body, wherein an inside of the water muffler is divided into a single expansion chamber and a resonator chamber, and a front exhaust pipe coupled to the engine and a rear exhaust pipe opened to an outside of the boat are connected to the expansion chamber.

According to a second aspect of the invention, in addition to the first aspect, a water-controlling plate is provided in an upper side of the expansion chamber between the front exhaust pipe and the rear exhaust pipe, and the water-controlling plate opened to an inside of the expansion chamber.

With respect to such exhaust system for a small-sized boat as described above, in a small-sized boat including a water muffler at one point along exhaust pipes extending from an engine disposed in the boat body, the inside of the water muffler is divided into a single expansion chamber and a resonator chamber, and a front exhaust pipe coupled to the engine and a rear exhaust pipe opened to the outside of the boat are connected to the expansion chamber. Therefore, according to this exhaust system for the small-sized boat, operations and effects as below can be obtained.

That is, the expansion chamber of the water muffler, whose capacity is limited due to the layout inside the small-sized boat, is made to be single to increase the capacity thereof. At the same time, the front exhaust pipe coupled to the engine and the rear exhaust pipe opened to the outside of the boat are connected to the expansion chamber, whereby an attenuation operation for exhaust noises in a low frequency band can be improved. Moreover, the resonator chamber is provided by dividing the inside of the water muffler, whereby exhaust noises in a low frequency band can be further reduced.

Hence, according to this exhaust system, exhaust noises in a low frequency band, which are most disturbing noises in a small-sized boat, can be effectively reduced.

In addition, since the inside of the water muffler is divided into the single expansion chamber and the resonator chamber, it is not necessary to provide the resonator chamber separately from the water muffler, and therefore, the exhaust system as a whole can be made smaller. Accordingly, in addition, the layout inside the narrow boat is facilitated, and the cost thereof can be reduced.

In other words, according to this exhaust system, the water muffler as well as the exhaust system as a whole can be made smaller. At the same time, even though the water muffler and the system are made smaller with low costs, exhaust noises in a low frequency band, which are most disturbing noises in the small-sized boat, can be effectively reduced.

According to the second aspect of the invention described above, in the exhaust system for the small-sized boat, between the front exhaust pipe opened to the inside of the expansion chamber and the rear exhaust pipe, a water-controlling plate is provided in an upper side of the expansion chamber. Therefore, operations and effects as below can be further obtained.

That is, as described above, in a case where the capacity of the expansion chamber inside the water muffler is made large, and where the front exhaust pipe coupled to the engine and the rear exhaust pipe opened to the outside of the boat are connected to the expansion chamber, if no measures are taken and if the small-sized boat is turned over, water inside the expansion chamber will rampage more, which may increase a possibility that the water runs adversely through the front exhaust pipe toward the engine.

In contrast, according to the exhaust system for the small-sized boat described above, between the front exhaust pipe opened to the inside of the expansion chamber and the rear exhaust pipe, the water-controlling plate is provided in the upper side of the expansion chamber. Therefore, if the small-sized boat is turned over, the water rampage is suppressed by the water-controlling plate, and as a result, the possibility that the water runs adversely toward the engine is reduced.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

In the following description, selected illustrative embodiments of the present invention are described, in connection with working examples shown in the accompanying drawings. The selected embodiments and working examples are intended to illustrate, rather than to limit the invention.

Figure 1:
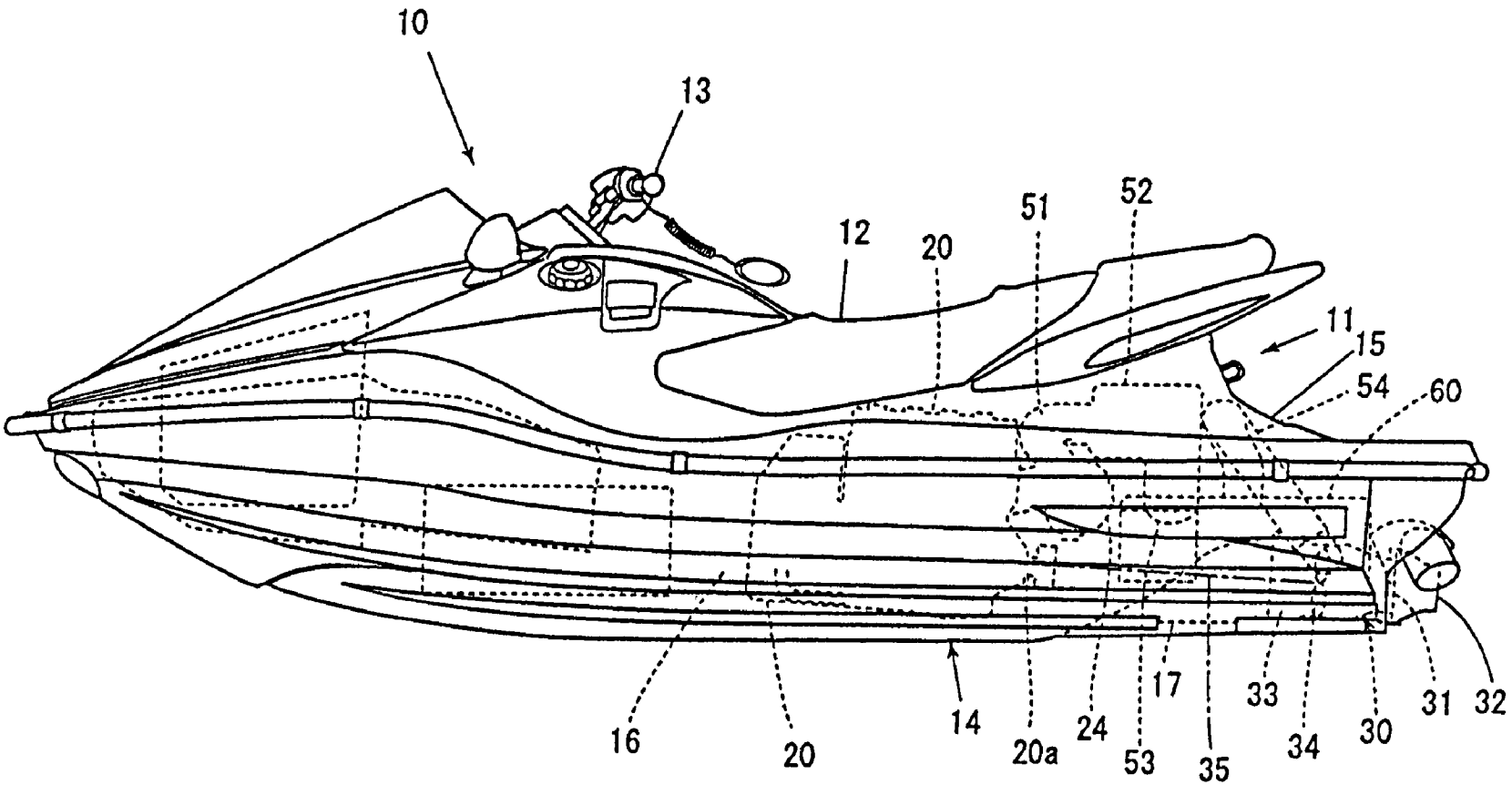
FIG. 1 is a schematic side view showing an example of a small-sized boat employing an embodiment of an exhaust system for a small-sized boat according to the present invention.

FIG. 1 is a schematic side view showing an example of a small-sized boat employing an embodiment of an exhaust system for a small-sized boat according to the present invention.

As shown in FIG. 1, the small-sized boat 10 is a saddle type small-sized boat, and can be steered by a rider sitting on a seat 12 on a boat body 11, who grips a steering handle bar 13 having a throttle lever gripped.

The boat body 11 has a floating body structure where a hull 14 and a deck 15 are joined with a space 16 formed therebetween. In the space 16, an engine 20 is mounted above the hull 14, and a jet pump (jet propelling pump) 30 serving as propelling means driven by the engine 20 is provided at a rear portion of the hull 14.

The jet pump 30 includes a flow path 33 extending from an intake 17 opened to the bottom of the boat to a jet 31 opened to a rear end of the boat body and a nozzle 32, and an impeller 34 disposed in the flow path 33, and a shaft 35 of the impeller 34 is connected to an output power shaft 20*a* of the engine 20. Accordingly, when the impeller 34 is driven to rotate by the engine 20, then water taken in through the intake 17 passes the nozzle 32 and is jetted from the jet 31, whereby the boat body 11 is propelled. The driving speed of the engine 20, that is, the propelling force by the jet pump 30, is controlled by a turning operation of the throttle lever (not shown) of the steering handle bar 13 described above. The nozzle 32 is associated with the steering handle bar 13 by an un-illustrated control wire, and is controlled to be turned by a turning operation of the handle bar 13, whereby the advancing direction can be changed.

The engine 20 is a DOHC and dry sump type inline four-cylinder four-cycle engine, and is disposed such that the crankshaft 20*a* thereof extends along forward and rearward directions of the boat body 11.

A turbo charger 24 is disposed at the rear of the engine 20, and an exhaust gas exit of an engine exhaust manifold is connected to a turbine portion of the turbo charger 24.

Exhaust gas which has rotated a turbine in the turbine portion of the turbo charger 24 is emitted to a water muffler 60 through first exhaust pipes 51 having a water jacket, a back flow blocking chamber 52 for blocking a back flow of water at a time of a turnover (entering of water to the turbo charger 24 and the like), and a second exhaust pipe 53 (front exhaust pipe). Moreover, the exhaust gas is emitted from the water muffler 60 through an exhaust/discharge pipe (rear exhaust pipe) 54 opened to the outside of the boat body to a pump chamber where the jet pump 30 is housed.

Accordingly, exhaust gas from the engine 20 is emitted through exhaust pipes having a water jacket (foregoing first exhaust pipes 51, back flow blocking chamber 52 and second exhaust pipe 53 in this embodiment) into the water muffler 60 together with the water that has passed the water jacket.

Figure 2:
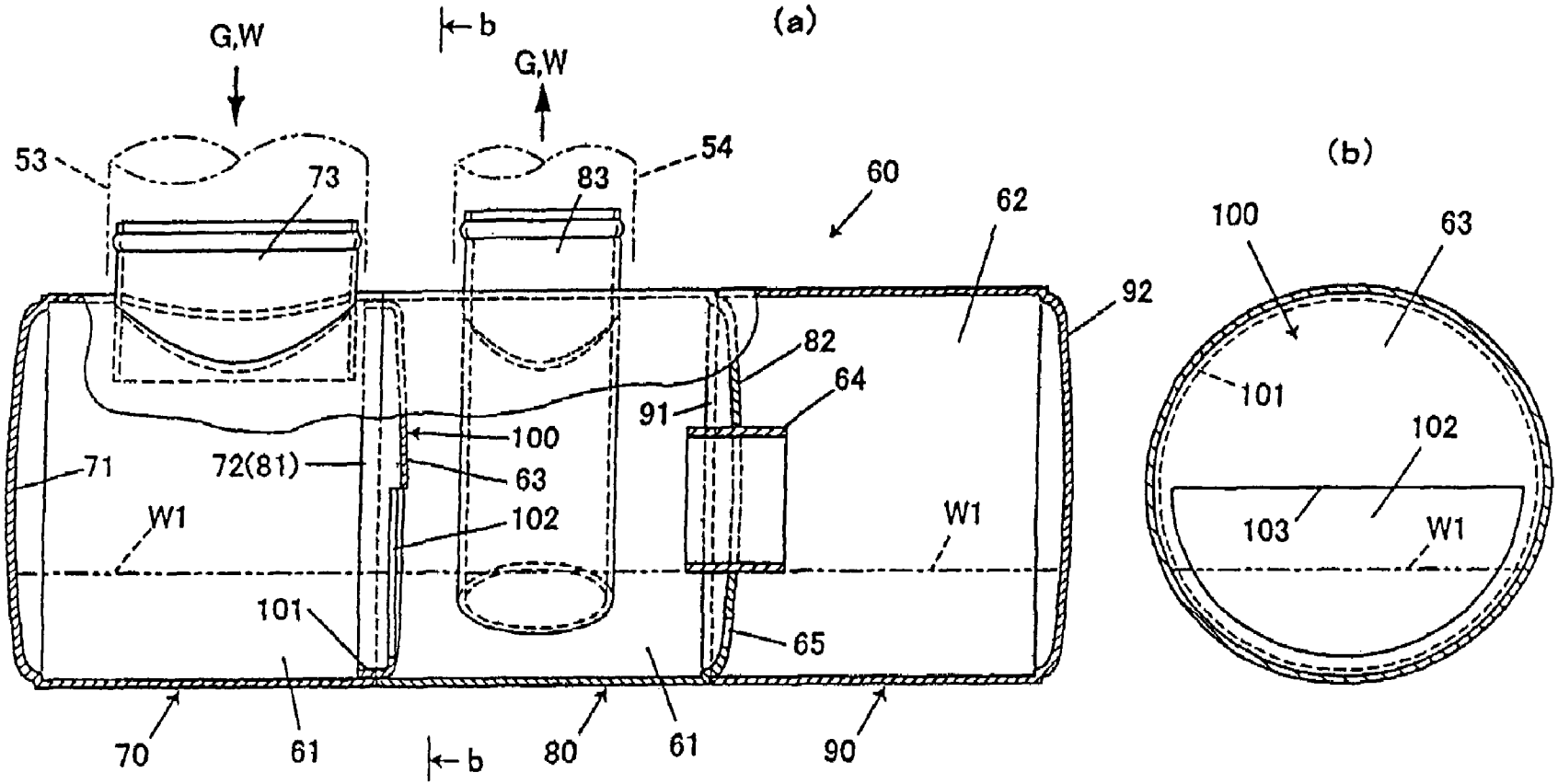
FIGS. 2(*a*) and 2(*b*) are views showing a water muffler, where FIG. 2(*a*) is a partial cutaway side view and FIG. 2(*b*) is a partially omitted b—b cross-section in FIG. 2(*a*) of an embodiment of the present invention.

FIGS. 2(*a*) and (*b*) are views showing the water muffler 60. FIG. 2(*a*) is a partial cutaway side view and FIG. 2(*b*) is a partially omitted b—b cross section in FIG. 2(*a*).

The inside of the water muffler 60 is divided into a single expansion chamber 61 and a resonator chamber 62, and the front exhaust pipe 53 coupled to engine 20 and the rear exhaust pipe 54 opened to the outside of the boat body are connected to the expansion chamber 61. As described above, exhaust gas G and cooling water W are introduced to the inside of the water muffler 60 from the front exhaust pipe 53 and exhausted to the outside of the ship from the water muffler 60 through the rear exhaust pipe 54.

In the water muffler 60, between the front exhaust pipe 53 opened to the inside of the expansion chamber 61 and the rear exhaust pipe 54, a water-controlling plate 63 is provided in an upper side of the expansion chamber 61.

The resonator chamber 62 has a characteristic that an attenuation amount in a low frequency band (100 to 200 Hz) is large.

A reference numeral 64 denotes a communicating pipe connecting the expansion chamber 61 and the resonator chamber 62, and a reference numeral 65 denotes a communicating hole connecting the expansion chamber 61 and the resonator chamber 62.

The water muffler 60 includes a first cylindrical body 70, a second cylindrical body 80, a third cylindrical body 90, and a disk 100.

A front side 71 of the first cylindrical body 70 is closed, while a rear side 72 is opened. In an upper portion of the first cylindrical body 70, a connecting pipe 73 for coupling the front exhaust pipe 53 is connected by welding or the like. The disk 100 is provided to the rear side 72. The circumferential portion of the disk 100 is bent 90 degrees (bent portion is shown by a reference numeral 101). Approximately half the lower portion of the disk 100 is knocked through in a semicircular shape as shown in FIG. 2(*b*), and this knocked-through portion forms a semicircular opening 102 while the upper portion forms the foregoing water-controlling plate 63. This disk 100 is joined at the rear portion of the first cylindrical body 70 by, e.g., welding the bent portion 101 to the inner circumferential portion of the opening 72 of the first cylindrical body 70.

The second cylindrical body 80 is opened at a front side 81 thereof. A rear wall 82 is provided with the communicating pipe 64 by welding or the like, and, at the same time, the communicating hole 65 is opened in a lower portion thereof. Moreover, in an upper portion of the second cylindrical body 80, a coupling pipe 83 for coupling the rear exhaust pipe 54 is connected by welding or the like. The first cylindrical body 70 and the second cylindrical body 80 are joined by joining the front circumferential portion of the second cylindrical body 80 to the disk 100 (and/or the rear portion of the first cylindrical body 70) by welding or the like, whereby the single expansion chamber 61 is formed.

The third cylindrical body 90 is opened at a front side 91 thereof, while a rear side 92 is closed. The front circumferential portion of the third cylindrical body 90 is joined to the rear circumferential portion of the cylindrical body 80 by welding or the like, whereby the resonator chamber 62 is formed.

In FIGS. 2(*a*) and (*b*), W1 shows a level of water discharged from the front exhaust pipe 53 into the water muffler 60 together with exhaust gas. A bottom edge 103 of the water-controlling plate 63 (top edge of the opening 102) is positioned above the water level W1, and the communicating pipe 64 is also positioned above the water level W1. The communicating hole 65 is positioned below the water level W1.

The above-described exhaust system for the small-sized boat includes the water muffler 60 at one point along the exhaust pipe extending from the engine 20 disposed in the boat body 11. The inside of the water muffler 60 is divided into the single expansion chamber 61 and the resonator chamber 62, and the front exhaust pipe 53 coupled to the engine 20 and the rear exhaust pipe 54 opened to the outside of the boat are connected to the expansion chamber 61. Hence, according to this exhaust system for the small-sized boat, the following operational effects can be obtained.

That is, the expansion chamber of the water muffler 60, whose capacity is limited due to the layout in the small-sized boat, is made to be the single expansion chamber 61 to increase the capacity thereof. Meanwhile, the front exhaust pipe 53 coupled to the engine 20 and the rear exhaust pipe 54 opened to the outside of the boat are connected to the expansion chamber 61, whereby the attenuation operation for exhaust noises in a low frequency band can be improved. Moreover, the resonator chamber 62 is provided by dividing the water muffler 60, whereby the exhaust noises in a low frequency band can be further reduced.

Therefore, according to this exhaust system, the exhaust noises in a low frequency band, which are most disturbing noises in the small-sized boat, can be effectively reduced.

In addition, since the inside of the water muffler 60 is divided into the single expansion chamber 61 and the resonator chamber 62, the resonator chamber 62 is not required to be provided separately, whereby the whole exhaust system can be made smaller. Hence, the layout in the narrow boat is facilitated, thereby reducing the costs.

In other words, according to the exhaust system, the water muffler 60 and the whole exhaust system can be made smaller. At the same time, even though the sizes thereof are reduced with low costs, the exhaust noises in a low frequency band, which are most disturbing noises in the small-sized boat, can be efficiently reduced.

As described above, in a case where the capacity of the expansion chamber 61 inside the water muffler 60 is made large, and where the front exhaust pipe 53 coupled to the engine and the rear pipe 54 opened to the outside of the boat are connected to the expansion chamber 61, if no measures are taken and if the small-sized boat is turned over, water inside the expansion chamber 61 will slosh about, which increases a possibility that the water could move adversely through the front exhaust pipe 53 toward the engine.

In contrast, according to the exhaust system for the small-sized boat according to the invention, between the front exhaust pipe 53 opened to the inside of the expansion chamber 61 and the rear exhaust pipe 54, the water-controlling plate 63 is provided in the upper side of the expansion chamber 61. Thus, if the small-sized boat is turned over, the sloshing of the water is suppressed by the water-controlling plate 63, and as a result, a possibility that the water could enter the engine is reduced.

Hereinbefore, an embodiment of the present invention has been described.

Figure 3:
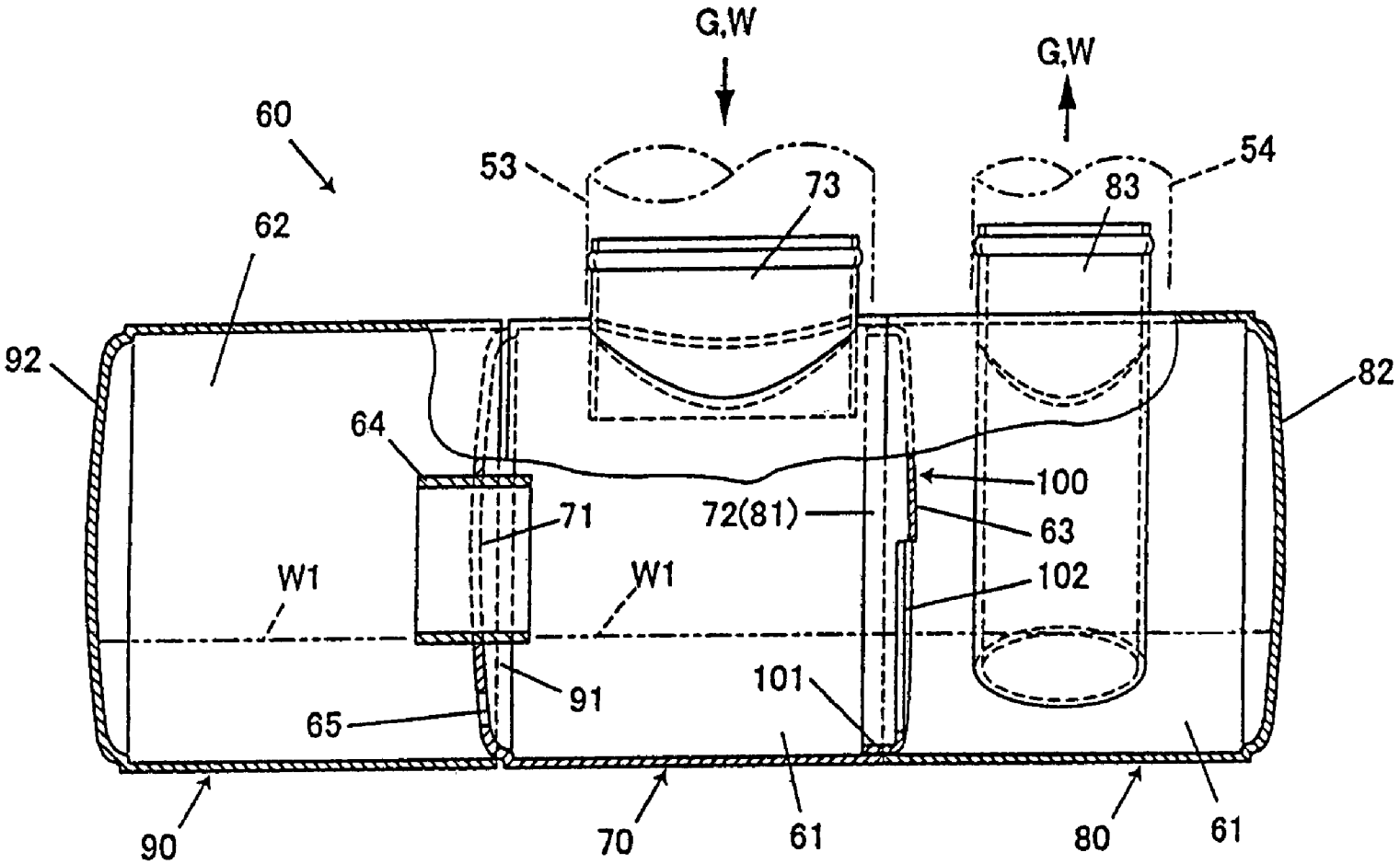
FIG. 3 is a partial cutaway side view showing another embodiment of the present invention.

According to another embodiment of the invention, as shown in FIG. 3, the resonator chamber 62 in the third cylindrical body 90 may be formed in a front portion of the water muffler 60 and communicate with the expansion chamber 61 at one end of the first cylindrical body 70, rather than at an opposite end of the second cylindrical body 80 as in the embodiment of FIG. 2.

Although the present invention has been described herein with respect to a limited number of presently preferred embodiments, the foregoing description is intended to be illustrative, and not restrictive. Those skilled in the art will realize that many modifications of the embodiments could be made which would be operable. All such modifications are within the scope of the claims, and are intended to be within the scope and spirit of the invention.

Having thus, described the invention, what is claimed is:

1. In a small-sized boat including a water muffler at one location along exhaust pipes extending from an engine disposed in a boat body, an exhaust system for the small-sized boat, comprising:

the water muffler having an interior divided into a single expansion chamber and a resonator chamber;

a front exhaust pipe coupled to the engine and connected to said water muffler at an upper side of the expansion chamber; and a rear exhaust pipe opened to an outside of the boat and also connected to said water muffler at the upper side of said expansion chamber, wherein the water muffler significantly reduces low frequency exhaust noises.

2. The exhaust system for the small-sized boat according to claim 1, further comprising a water-controlling plate provided in the upper side of said expansion chamber between the front exhaust pipe and said rear exhaust pipe, said water-controlling plate opened to an inside of said expansion chamber.

3. The exhaust system for the small-sized boat according to claim 1, wherein said resonator chamber is enclosed within said water muffler and communicates with one end of said single expansion chamber.

4. The exhaust system for the small-sized boat according to claim 1, further comprising a communication pipe between said resonator chamber and said single expansion chamber, said communication pipe is disposed above a water level normally maintained in said water muffler during operation of said boat.

5. The exhaust system for the small-sized boat according to claim 2, wherein said water-controlling plate is disposed above a water level normally maintained in said water muffler during operation of said boat.

6. The exhaust system for the small-sized boat according to claim 2, wherein said front and rear exhaust pipes are coupled to said water muffler, in communication with said single expansion chamber on opposite sides of said water-controlling plate.

7. In a small-sized boat including a water muffler at one location along exhaust pipes extending from an engine disposed in a boat body, an exhaust system for the small sized boat comprising:

the water muffler having an interior divided into a single expansion chamber and a resonator chamber;

a front exhaust pipe coupled to the engine and connected to said water muffler at an upper side of the expansion chamber;

a rear exhaust pipe opened to an outside of the boat and also connected to said water muffler at an upper side of said expansion chamber;

a water-controlling plate provided in an upper side of said expansion chamber between the front exhaust pipe and said rear exhaust pipe, said water controlling plate opened to an inside of said expansion chamber; and said water-controlling plate having a shape corresponding to substantially one half of a cross sectional area of the single expansion chamber.

8. The water muffler according to claim 7, wherein said water-controlling plate is oriented substantially vertically.

9. The water muffler according to claim 7, wherein said water muffler is oriented substantially horizontally.

10. The water muffler according to claim 7, wherein said water-controlling plate is disposed above a water level normally maintained in said water muffler during operation of said boat.

11. A water muffler for use in an exhaust system of a small-sized boat, said water muffler comprising:

a muffler body defining therein a single expansion chamber and a resonator chamber;

one connecting pipe provided with said muffler body which is adapted to connect to an upper side of the single expansion chamber to a front exhaust pipe extending from an engine of the small-sized boat; and another connecting pipe provided with said muffler body which is adapted to connect to the upper side of the single expansion chamber to a rear exhaust pipe opened to the outside of the boat.

12. The water muffler according to claim 11, further comprising a water-controlling plate provided in an upper side of said single expansion chamber between the connecting pipes, wherein said water-controlling plate is oriented substantially vertically.

13. The water muffler according to claim 11, wherein said resonator chamber is enclosed within said water muffler and communicates with one end of said single expansion chamber.

14. The water muffler according to claim 11, further comprising a communication pipe between said resonator chamber and said single expansion chamber, said communication pipe is disposed above a water level normally maintained in said water muffler during operation of said boat.

15. The water muffler according to claim 12, wherein said water-controlling plate is disposed above a water level normally maintained in said water muffler during operation of said boat.

16. The water muffler according to claim 12, wherein said front and rear connecting pipes are coupled to the muffler body at an upper side of said single expansion chamber on opposite sides of said water-controlling plate.

17. A water muffler for use in an exhaust system of a small-sized boat, said water muffler comprising:

a muffler body defining therein a single expansion chamber and a resonator chamber;

one connecting pipe provided with said muffler body which is adapted to connect the single expansion chamber to a front exhaust pipe extending from an engine of the small-sized boat;

another connecting pipe provided with said muffler body which is adapted to connect the single expansion chamber to a rear exhaust pipe opened to an outside of the boat;

a water-controlling plate provided in an upper side of said single expansion chamber between the connecting pipes; and said water-controlling plate having a shape corresponding to substantially one half of a cross sectional area of the single expansion chamber.

18. The water muffler according to claim 17, wherein said water-controlling plate is oriented substantially vertically.

19. The water muffler according to claim 17, wherein said muffler body is oriented substantially horizontally.

20. The water muffler according to claim 17, wherein said water-controlling plate is disposed above a water level normally maintained in said water muffler during operation of said boat.

* * * * *